US008382391B1

(12) United States Patent
Potter et al.

(10) Patent No.: US 8,382,391 B1
(45) Date of Patent: Feb. 26, 2013

(54) VEHICLE SECURITY BARRIER

(75) Inventors: Thomas E. Potter, Hummelstown, PA (US); Elizabeth Ann Elliott, Hershey, PA (US)

(73) Assignee: Pro Barrier Engineering, LLC, Hummelstown, PA (US)

( * ) Notice: Subject to any disclaimer, the term of this patent is extended or adjusted under 35 U.S.C. 154(b) by 0 days.

(21) Appl. No.: 13/444,663

(22) Filed: Apr. 11, 2012

Related U.S. Application Data

(60) Provisional application No. 61/474,688, filed on Apr. 12, 2011.

(51) Int. Cl.
*E01F 13/00* (2006.01)
*E01F 13/04* (2006.01)

(52) U.S. Cl. ..... 404/6

(58) Field of Classification Search ..... 404/6, 9–11
See application file for complete search history.

(56) References Cited

U.S. PATENT DOCUMENTS

| | | | | |
|---|---|---|---|---|
| 4,647,246 | A * | 3/1987 | Brink et al. | 404/6 |
| 6,158,948 | A * | 12/2000 | Calvert | 414/501 |
| 6,726,434 | B2 * | 4/2004 | Orthaus et al. | 414/539 |
| 6,752,582 | B2 * | 6/2004 | Garcia | 414/467 |
| 7,249,909 | B2 * | 7/2007 | Bibber | 404/6 |
| 7,306,398 | B2 * | 12/2007 | Doran, Jr. | 404/84.05 |

* cited by examiner

*Primary Examiner* — Raymond W Addie
(74) *Attorney, Agent, or Firm* — Miller Law Group, PLLC

(57) ABSTRACT

A roller barrier security system includes a pair of cylindrical concrete roller barriers mounted on a support apparatus in an elevated position to enable movement of the roller barriers onto a roadway to block the movement of traffic. The roller barriers are retained by cables wrapped around the cylindrical rollers and secured by a solenoid. A secondary restraint in the form of pivoted catch members also prevents the rollers from leaving the elevated position. Each catch member is secured by a slide block coupled to a drop weight secured by a trap door controlled by a second solenoid. To allow movement of the rollers, the two solenoids are activated which releases the wrap-around cable and the trap door. The falling drop weight pulls the slide block away from the catch member to allow pivoting thereof, while the released cable allows the rollers to move by gravity onto the roadway surface.

20 Claims, 10 Drawing Sheets

Fig. 11
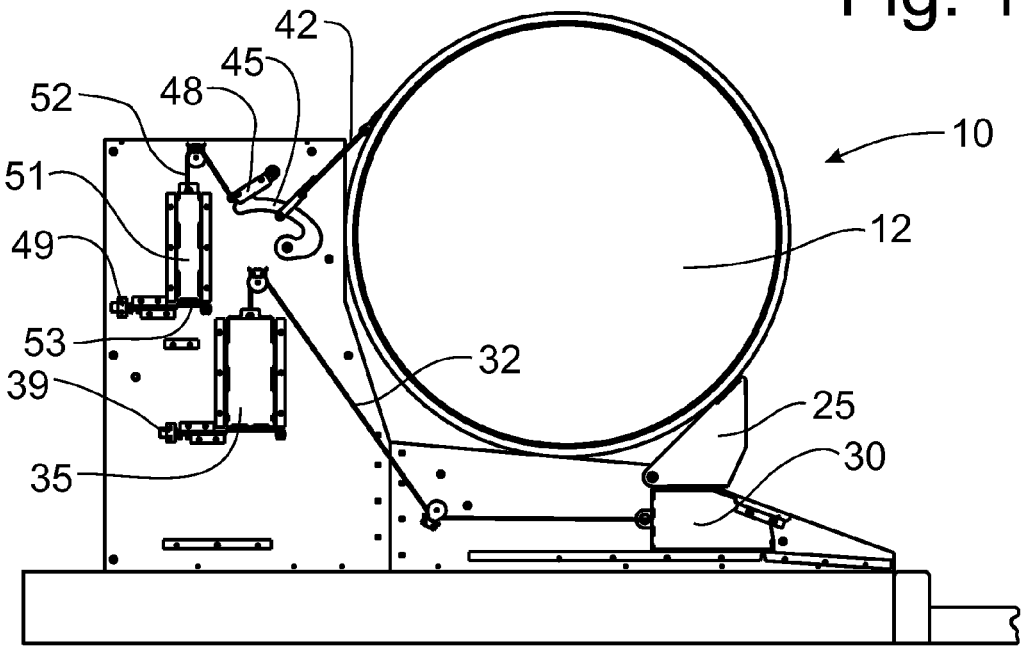
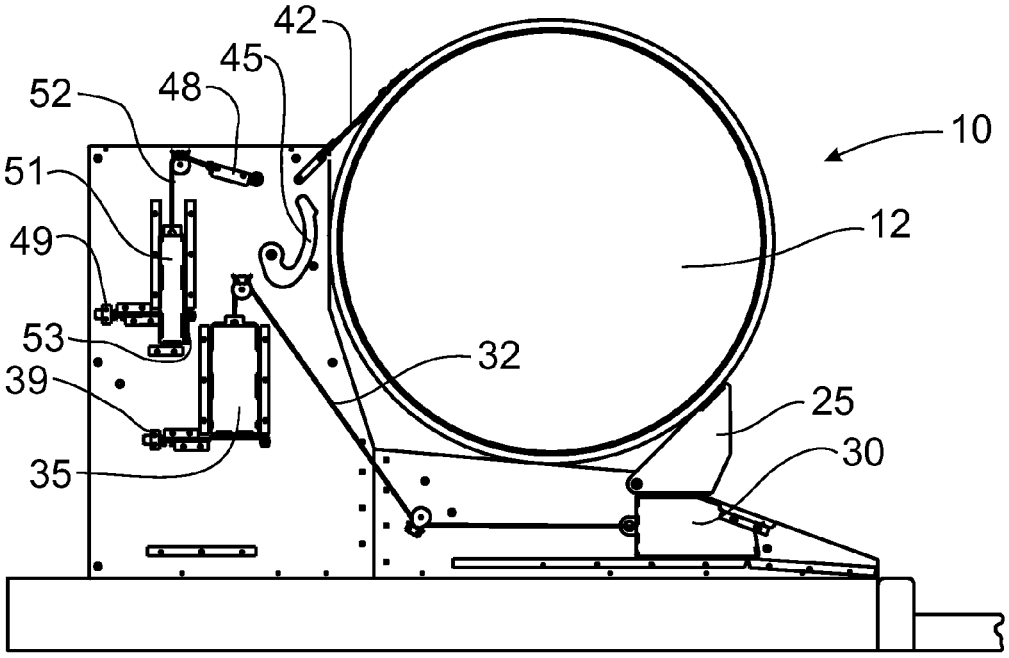
Fig. 12

VEHICLE SECURITY BARRIER

CROSS-REFERENCE TO RELATED APPLICATIONS

This application claims domestic priority on U.S. Provisional Patent Application Ser. No. 61/474,688, filed on Apr. 12, 2011, the content of which is incorporated herein by reference.

BACKGROUND OF THE INVENTION

The present invention relates generally to devices for preventing vehicles from passing beyond a predetermined point in a roadway to provide security control and, more particularly, to a roadway barrier that can be selectively actuated to restrict access over a roadway For many years, a small number of companies have sold vehicle crash barriers primarily designed to thwart deliberate vehicle-based attacks of buildings. These barriers are generally heavy steel structures imbedded in concrete or concrete structures in a road surface that physically obstruct the roadway. These heavy steel structure devices are designed so that a barrier device (usually a steel plate) can be raised or lowered to control the ability of a vehicle to pass through or over the barrier and, thus, gain access to the building being secured. These devices differ from the barriers commonly encountered in parking garages and other public venues, in that they have very high stopping power, for example, preventing a 15,000-pound explosive laden truck traveling at 50 mph from passing beyond the vehicle barrier.

Barriers come in numerous designs, but they can generally be categorized in three conventional types: plate, beam, and bollard. The plate barrier can be oriented to lay relatively flat on the surface of the roadway and be selectively actuated to be angled upwardly upon a perceived threat to form a wedge that restricts passage of a vehicle. The plate barrier is considered to be a permanently installed device as the plate is supported on a concrete encased frame that is buried into the surface of the roadway. A variation of the plate barrier has been introduced recently into the marketplace as a portable barrier. Another variation is to fasten the plate barrier to the roadway, such as with bolts. This barrier device is essentially a plate type barrier that is not imbedded in concrete, but instead can be moved to different locations to accommodate the need for temporary or changing security needs. Since the portable plate barrier is not imbedded in concrete, stopping power is relatively limited.

The beam barrier incorporates a vertically movable beam that is typically pivotally supported at one end of the beam by a steel support that is imbedded in concrete to provide a relatively immovable object and at the opposing end by a similar steel support at the opposing side of the roadway. The beam barrier serves as a movable gate that can be raised vertically (or swung horizontally) to allow vehicles to pass or lowered into engagement with the steel supports at either end of the beam to provide a substantial resistance to the passage of any vehicle. As with the conventional plate barrier, the beam barrier provides a permanent installation and relatively high stopping power. Some beam barriers use bands of elastic material that are contained within the hollow beam and wrapped around the pivot structure for the beam to increase the resistance of the steel beam.

The bollards are typically permanently installed steel or concrete barriers that are typically not selectively movable, although vertical movement could be provided to permit the structure to rise into a passage restrictive position above the surface of the roadway, or be retracted into the ground to permit the passage of vehicles. Generally, bollards are a permanent structure that cannot be made portable without loss of substantial stopping power capabilities.

Historically, vehicle barriers achieved their effectiveness by their mass and by the fact that they were permanently anchored in concrete. The vehicle barrier produced by Nasatka Barrier, Inc. is a beam-type of barrier that utilizes bands in the drop arm (beam) that are utilized to help stop the passage of vehicles. This barrier uses heavy-duty commercial straps or bands (usually nylon) of the kind used to lift large static loads in other commercial applications. While the bands are very strong and have a high stopping power, this beam-type barrier utilizes massive structures to engage each end of the movable beam to resist the impact of the oncoming vehicle. The bands are used to reinforce the drop arm and are anchored at the pivot end of the drop arm.

Conventional barriers have another disadvantage inherent in their designs in that each barrier design requires active mechanical movement of very heavy structures. Heavy steel plates (plate barriers) or heavy cylinders (bollard barriers) have to be raised against gravity in order to stop vehicles. Current vehicle barriers require approximately two seconds for emergency activation from an open position in which the vehicle can pass by the barrier to a deployed position in which a vehicle is prevented from passing by or over the barrier. Activation times for conventional beam barriers and sliding gate barriers are even longer, averaging about ten seconds for barriers that are one traffic lane wide and substantially longer for larger two lane barriers.

In some security barrier installations, a secondary security barrier is installed at a location that is spaced from the primary security barrier to provide a secondary level of protection from the intrusion of vehicles. With such secondary security barriers, the response time is not a critical factor as typically the secondary security barrier is sufficiently spaced from the primary barrier that an operator has ample time to actuate the barrier. However, cost in the manufacture and installation of such secondary security barriers is a significant concern.

Accordingly, it would be desirable to provide an effectively operable, yet low cost vehicle security barrier that can be actuated manually by an operator.

SUMMARY OF THE INVENTION

It is an object of this invention to overcome the disadvantages of the prior art by providing a low cost security barrier that can be manually operated by an operator.

It is another object of this invention to provide a security barrier that is formed from a pair of large rollers mounted in an elevated location adjacent a roadway surface to roll into an interference position on the roadway when released from the elevated support.

It is a feature of this invention that the rollers can be constructed from concrete formed in a cylindrical form to create a pair of large rollers that can block a highway.

It is an advantage of this invention that the roller barriers can be formed inexpensively.

It is another advantage of this invention that can be deployed easily through manual operation or by automatic operation.

It is another feature of this invention that the rollers are retained in an elevated position by a restraint mechanism that allows the rollers to move onto the roadway surface when released.

It is still another advantage of this invention that the movement of the rollers from the elevated position onto the roadway surface is powered by gravity.

It is still another feature of this invention that the support apparatus incorporates a back-up restraint that retains the rollers in the elevated position if the primary restraint mechanism fails or is inadvertently released.

It is yet another feature of this invention that the primary restraint mechanism can be a cable or a strap wrapped around the roller barrier while in the elevated position, the cable being retained in a latched position by a solenoid.

It is a further feature of this invention that the secondary restraint mechanism can be a pivoted catch member that is locked into an interfering position by a slide block.

It is yet another advantage of this invention that the slide block can be moved into a non-interfering position by a drop weight held in a raised position by a latched trap door.

It is a further advantage of this invention that the unlatching of the trap door for the drop weight can be accomplished through a solenoid.

It is still another object of this invention that the roller barriers can be deployed in an angular orientation that allows the roller barriers to block a larger width of roadway surface when moved from the elevated position.

It is a further object of this invention to provide a container in which the roller barriers can be mounted to improve the aesthetics of the installation of the roller barrier system.

It is another feature of this invention that the container can be provided with a pivoted door that when opened forms a ramp over which the roller barrier can travel to reach the roadway surface.

It is still another feature of this invention that the mounting of the support structure within a container will make the roller barrier system portable.

It is another advantage of this invention that the deployment of the roller barrier system is facilitated by mounting the support structure within a container that can be easily positioned along the side of a selected roadway surface.

It is yet another feature of this invention that the actuation of both the primary and secondary retention mechanism retaining the roller barrier on the elevated support surface can be operated through a drop weight actuator.

It is still another advantage of this invention that the drop weight actuation devices permit the utilization of a solenoid to deploy the retention mechanism without overstressing the operation of the solenoid.

It is a further object of this invention to provide a roller barrier system blocking the passage of traffic along a roadway surface which is durable in construction, inexpensive of manufacture, carefree of maintenance, facile in assemblage, and simple and effective in use.

These and other objects, features and advantages are accomplished according to the instant invention by providing a roller barrier system having a pair of cylindrical concrete roller barriers mounted on a support apparatus in an elevated position to enable the movement of the roller barriers onto a roadway to block the movement of traffic. The roller barriers are retained by cables wrapped around the cylindrical rollers and secured by a solenoid. A secondary restraint in the form of pivoted catch members also prevents the rollers from leaving the elevated position. Each catch member is secured by a slide block coupled to a drop weight secured by a trap door controlled by a second solenoid. To allow movement of the rollers, the two solenoids are activated which releases the wrap-around cable and the trap door. The falling drop weight pulls the slide block away from the catch member to allow pivoting thereof, while the released cable allows the rollers to move by gravity onto the roadway surface.

BRIEF DESCRIPTION OF THE DRAWINGS

The advantages of this invention will be apparent upon consideration of the following detailed disclosure of the invention, especially when taken in conjunction with the accompanying drawings wherein:

FIG. 11 is an enlarged front elevational view of one side of the vehicle security barrier similar to that of FIG. 4, but depicting a drop weight mechanism for deploying the primary retention mechanism, the drop weight being shown in the elevated position retained by a solenoid operated trap door;

FIG. 12 is an enlarged front elevational view of one side of the vehicle security barrier as shown in FIG. 11, but with the drop weight for the primary retention mechanism being deployed to release the primary retention mechanism;

DETAILED DESCRIPTION OF THE PREFERRED EMBODIMENT

Figure 1:
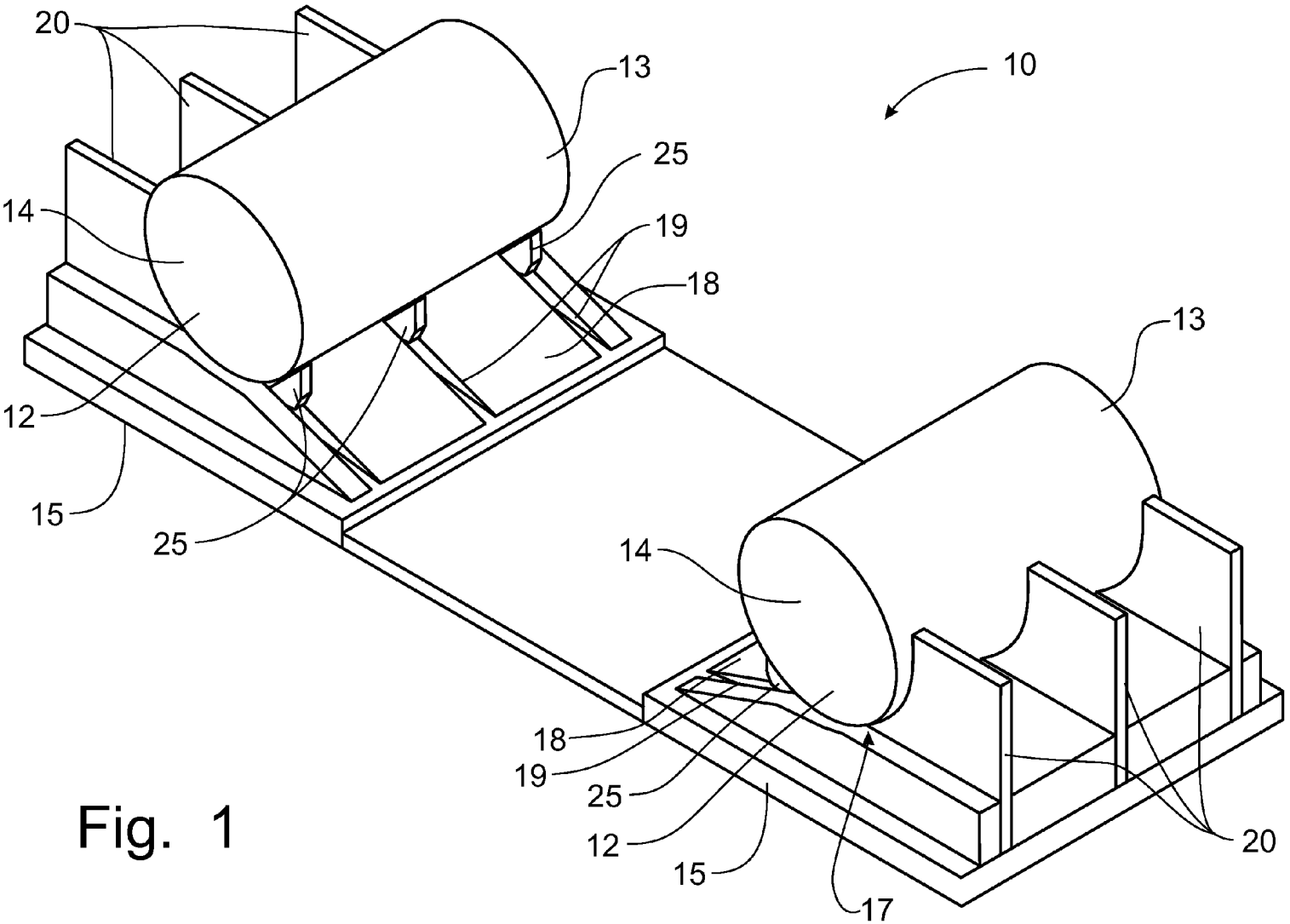
FIG. 1 is a schematic perspective view of a vehicle security barrier incorporating the principles of the instant invention, the barrier having a representative three actuator panels on each side of the highway and being oriented in the ready position.
Figure 2:
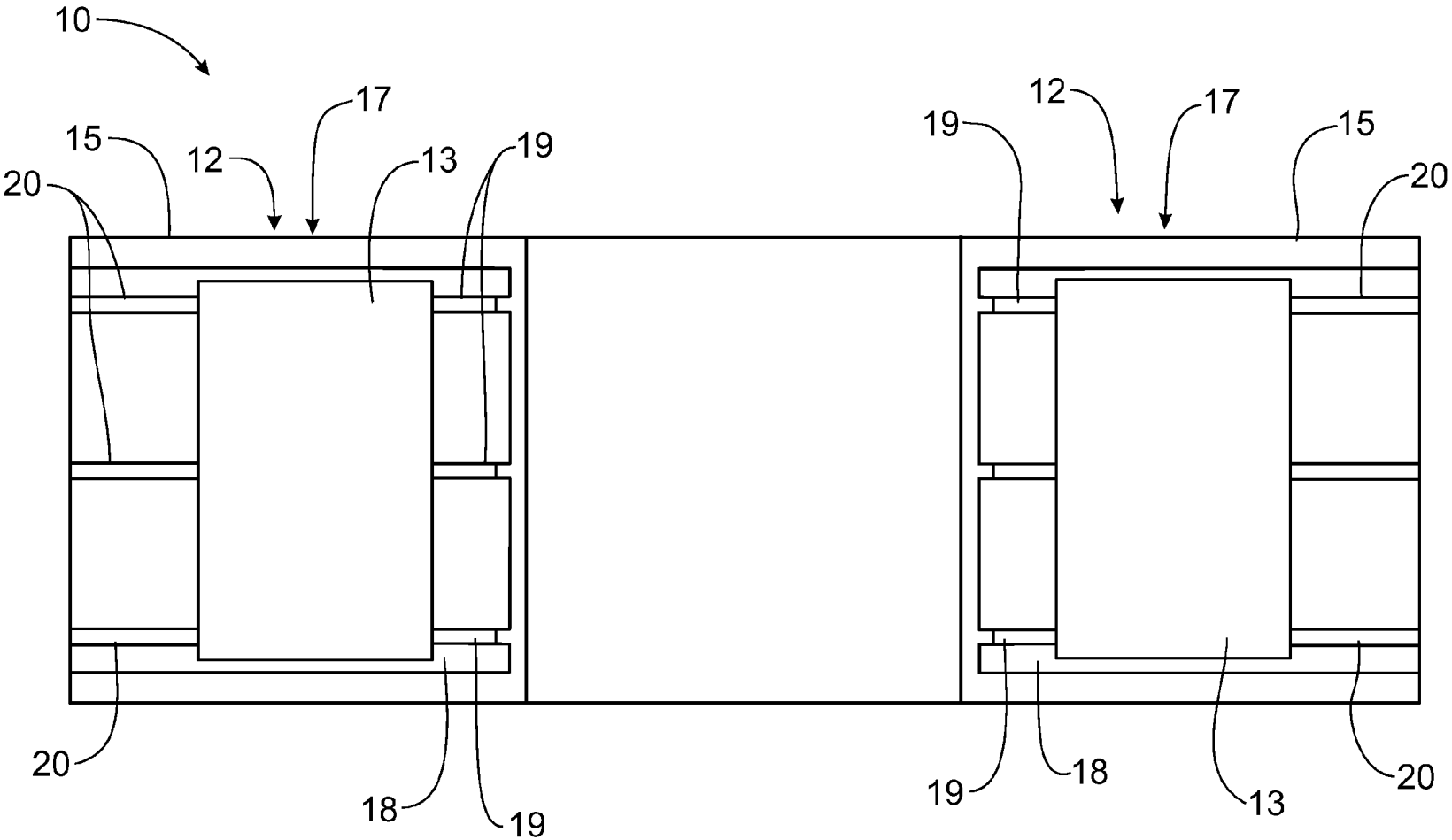
FIG. 2 is a schematic top plan view of the vehicle security barrier shown in FIG. 1.

Referring now to FIGS. 1-4, a vehicle security barrier system incorporating the principles of the instant invention can best be seen. The configuration of the barrier system 10 depicted in FIGS. 1-4 is a semi-permanent installation, meaning that the deployment of the vehicle security barrier 10 is such that there is typically no intent to move the barrier 10 to another location, but does not require an excavation of the road surface so that the barrier 10 could be re-located without requiring structural reconfiguration.

The barrier 10 is a gravity-powered apparatus having a circular roller member 12 positioned in an elevated location on a support apparatus 15 on opposing sides of a roadway surface so that when released from the stored, ready position, the roller members 12 will move by gravitational forces and roll off the support apparatus into an obstructing position on the roadway surface to form a barricade to the movement of vehicles past the deployed roller members 12, the operation of which will be described in greater detail below. The actuators 39, 49 are electrically actuated to cause the release of the roller members 12, which allows gravity to move the roller members 12 from an elevated, ready position to a barricading position on the roadway surface.

The roller members 12 are preferably formed by filling a conduit form 13 with concrete to create a heavy cylindrical member 12 that, when properly positioned on its side will roll from an elevated position to a lower deployed position. Typically, the conduit form 13 is a large corrugated metal or plastic drainage conduit, such as is used to provide a drainage conduit under a road, which have a length of up to twenty feet with a diameter of about six or seven feet. Thus, roller member 12 lengths of 5 feet, 6.67 feet, 10 feet and 20 feet provide the most likely length dimensions for the roller members 12. Once such a conduit form is filled with concrete, the resulting roller member 12 can have a substantial weight. For example, a six foot diameter, five foot length roller would have a weight of approximately 10 tons, while a seven foot diameter, 20 feet long roller member would weigh approximately 57 tons. Accordingly, installation of the vehicle security barrier 10, as described in greater detail below, will likely require utilization of a crane or other appropriate device to affect elevation of the roller member 12 onto the support apparatus 15.

Figure 4:
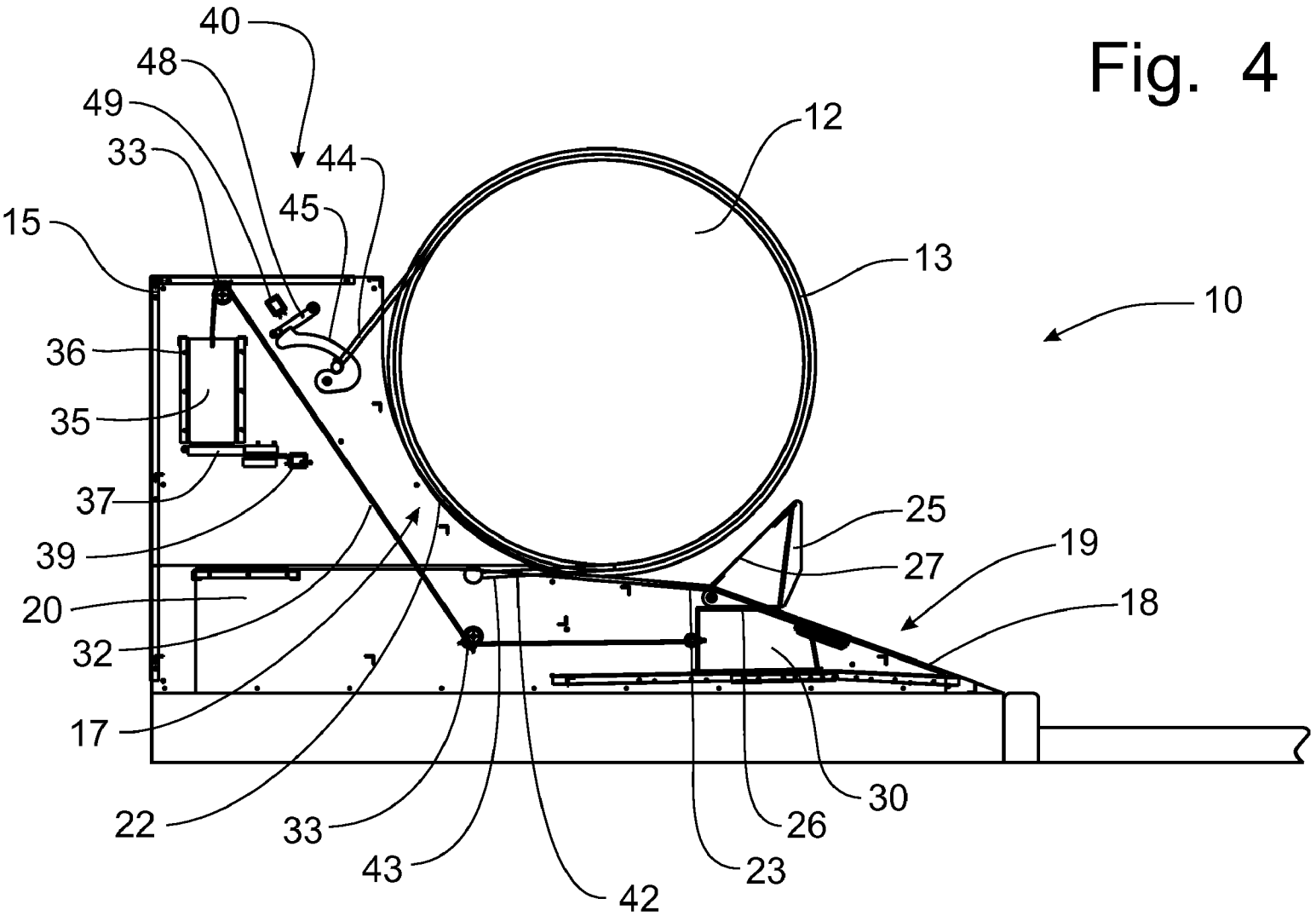
FIG. 4 is an enlarged front elevational view of one side of the vehicle security barrier shown in FIG. 3, the barrier being shown in the ready position.

A support apparatus 15 is located on opposite sides of the roadway surface and provides an upright apparatus that defines a cradle 17 on which the corresponding roller member 12 will reside in the elevated ready position. Depending on the length of the roller member 12, the support apparatus 15 will include a plurality of vertical fins 20 that define the cradle 17. In FIG. 1, a representative three vertical fins 20 are provided to support a roller member 12 expected to be approximately ten feet long. Longer or shorter roller members 12 can require additional or a lower number of vertical fins 20 for proper support and manipulation of the roller member 12. The configuration of the vertical fins 20 is best seen in FIG. 4. Each vertical fin 20 is formed with a curved portion 22 that defines the cradle 17, and terminates in a downwardly sloped ramp portion 23 that leads to the ramp 18 of the support apparatus 15 leading to the roadway surface. Preferably, the ramp 18 of the support apparatus 15 will extend in alignment with the ramp portion 23 of the vertical fins 20 so that the roller members 12 will be supported simultaneously on the ramps 18 and the ramp portions 23 of the vertical fins 20.

Figure 6:
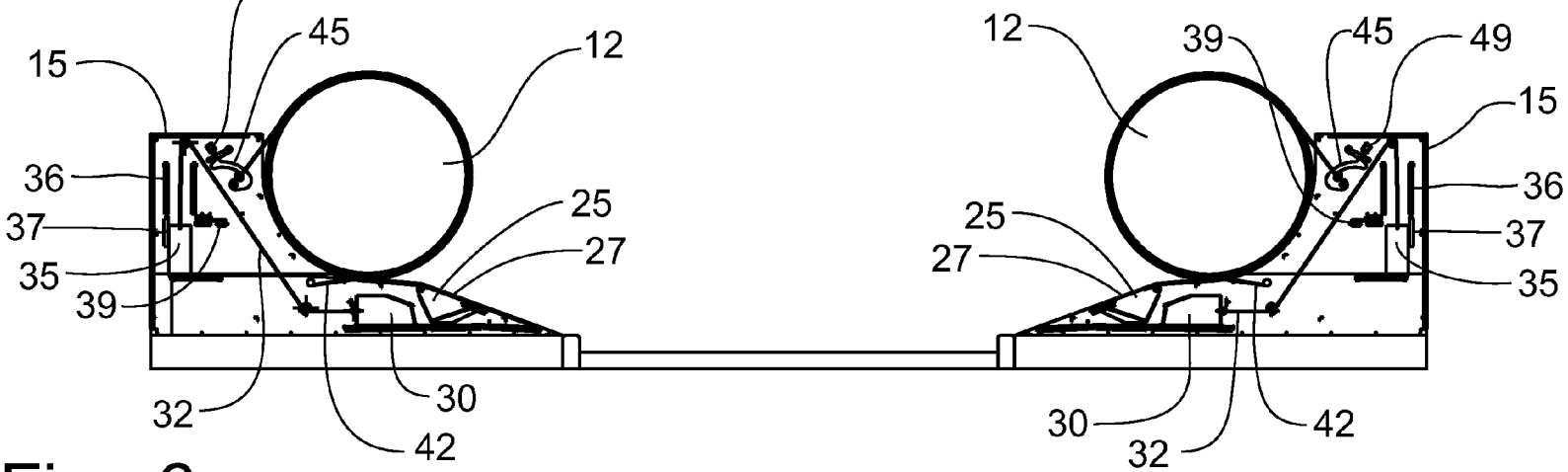
FIG. 6 is a front elevational view of the vehicle security barrier similar to that of FIG. 5, but showing the first actuator fully deployed to retract the catch member.

Each support apparatus 15 pivotally supports, either on or adjacent to each vertical fin 20, a catch member 25 that is pivotally movable between a raised position, which is shown in FIG. 4, and a lowered position, which is shown in FIG. 6. The catch member 25 is a secondary stop for the roller member 12 when in the elevated ready position. The weight of the roller member 12 is preferably not resting on the catch member 25, which will facilitate the actuation thereof, as will be described in greater detail below. Movement of the catch member 25 is controlled through the positioning of a slide block 30, which is located beneath the catch member 25 to interfere with the pivotal movement thereof unless retracted into the support apparatus 15. As seen in FIG. 4, the catch member 25 has a trapezoidal shape that includes a side 26 thereof that rests against the slide block 30 when located below the catch member 25. When the slide block 30 is retracted, the catch member 25 is free to drop into a slot 19 formed in the ramp 18 so that the long side 27 of the shape of the catch member 25 is aligned with or recessed below the ramp 18.

The slide block 30 is connected by a cable 32 to an actuation mechanism in the form of a drop weight 35 that is supported on the vertical fin 20 above the catch member 25. The changes in direction of the cable 32 are accommodated by appropriate guides 33 mounted on the vertical fin 20. The slide block 30 is mounted on the support apparatus 15 in a manner to facilitate linear sliding movement into the support apparatus 15 away from the ramp 18. The drop weight 35 is aligned within a channel 36 and retained in an elevated position, as seen in FIG. 4, by a trap door 37 that is pivotally connected to the vertical fin 20. The distal end of the trap door is supported on a solenoid 39 that can be energized electrically to retract its plunger to remove the support beneath the distal end of the trap door 37, whereupon the trap door 37 is freed to swing downwardly about its pivot and open the bottom of the channel 36. Once the trap door 37 is pivoted downwardly, the drop weight 35 is free to drop vertically by gravity, which pulls on the cable 32 and causes the slide block 30 to move rearwardly from the ramp 18, thus allowing the catch member 25 to drop into a non-interfering position within the corresponding slot 19 in the ramp 18.

With the catch member 25 retracted into the ramp 18, the roller member 12 can be released to move to the roadway surface. The roller member 12 is restrained in the cradle 17 by a cable 42 that is connected at a lower end 43 to the vertical fin 20, wrapped around the roller member 12, and restrained at an upper end 44 by a release mechanism 40. The release mechanism 40 can include an actuation mechanism in the form of a pivoted bayonet hook member 45 that is engaged with by the upper end 44 of the cable 42 to hold the upper end 44 in a secured manner when the bayonet hook member 45 is restrained in a locked position, as is best seen in FIG. 4, by a second solenoid 49. Preferably, the second solenoid 49 cooperates with a pivoted gate 48 that engages the bayonet hook member 45 to restrain the bayonet hook member 45 in the locked position. With the retraction of the solenoid 49, the gate 48 is free to rotate upwardly due to the force exerted on the bayonet hook member 45 by the cable or strap 42, which in turn allows the bayonet hook member 45 to rotate about its pivot to permit the cable 42 to be released from the bayonet hook member 45. With the cable 42 released and the catch member 25 retracted into the slot 19, the roller member 12 is free to roll down the ramp 18 onto the roadway surface.

One skilled in the art will recognize that the actuation mechanism associated with the release mechanism 40 can be configured as a mechanical linkage involving a drop weight in a manner similar to that described above with respect to the actuation mechanism associated with the catch member 25. Of concern is the force that is exerted on the solenoid 49 from the cable or strap 42 that is wrapped around the roller barrier 12 and restraining the roller barrier 12 on the support surface 18. By utilizing the solenoid 49 to control a gate for a drop weight, as described above for solenoid 39, the forces exerted on the solenoid 49 can be better controlled.

As is best seen in FIGS. 11 and 12, the release mechanism 40 can also be configured to incorporate a drop weight 51 to activate the operation of the release mechanism 40. Instead of the solenoid 49 being arranged to directly move the latch member 48 away from the bayonet hook member 45, which due to the weight of the roller member 12 on the cable or strap 42 can be substantial, the solenoid 49 is deployed to operate a trap door 53 retaining the drop weight 51 in an elevated position, as is shown in FIG. 11. The drop weight 51 is connected to the latch gate 48 by a cable 52 so that when the solenoid 49 is activated, the trap door 53 is opened to allow the drop weight 51 to fall, thus pulling on the attached cable 52 that in turn pivots the latch gate 48 and releases the bayonet hook 45 to pivot and release the cable/strap 42. Preferably, the latch gate 48 holds the bayonet hook member 45 in the retained position through engagement with a barb formed on the hook member 45 and the force exerted on the cable/strap 42 through retention of the roller barrier 12.

Figure 13:
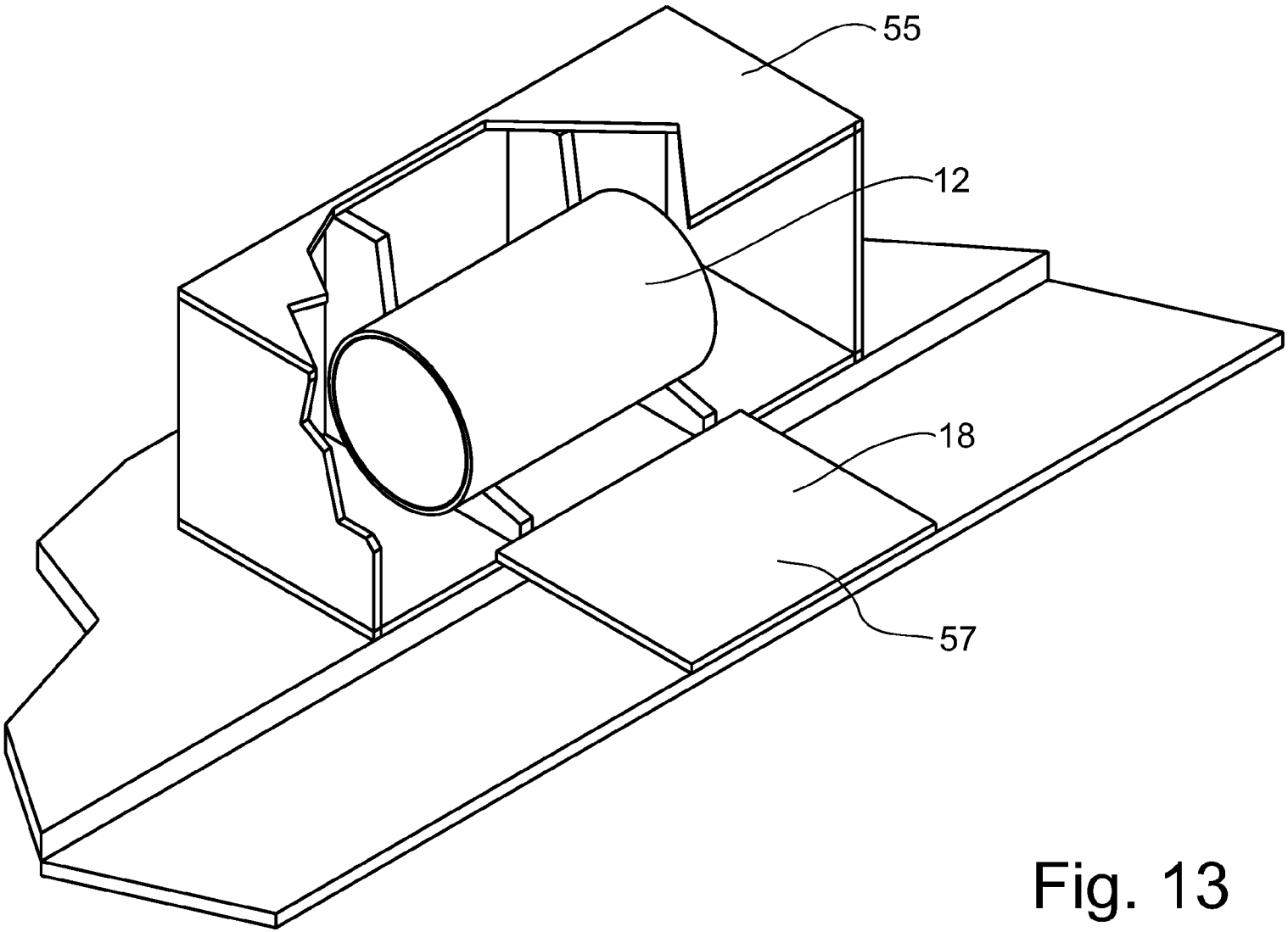
FIG. 13 is a perspective view of an alternative embodiment of the vehicle security barrier in which the roller barrier and the support surfaces are enclosed within a container to improve the aesthetics relating to the installation of the vehicle security barrier system, a portion of the container being broken away to better view the internal vehicle security barrier, the door of the container being deployed into a ramp for the release of the roller barrier to the roadway surface.
Figure 14:
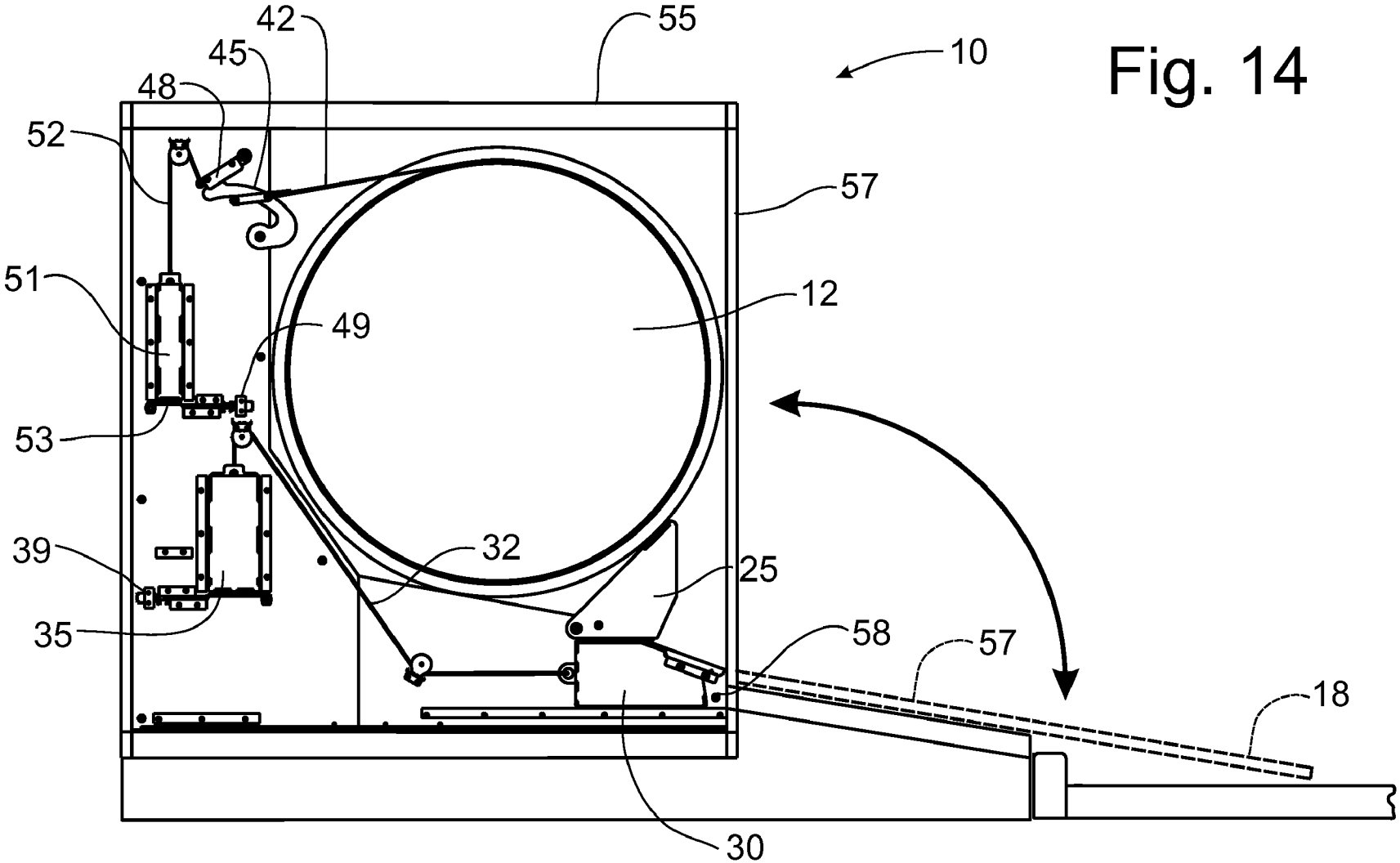
FIG. 14 is an enlarged front elevational view of one side of the vehicle security barrier system as shown in FIG. 13, the movement of the front door of the container being shown in phantom.

Referring now to FIGS. 13 and 14, a container 55 can be provided for the mounting of the support apparatus 15, which enables the roller barrier 12 and the support apparatus 15 to be hidden from view, but also facilitates the installation of the roller barrier system 10. The support structure 15 would be mounted within the container 55 so that the container would completely encompass the entire roller barrier system 10. With the support apparatus 15 being located within the container 55, the roller barrier system 10 can be easily deployed by simply positioning the container 55 along the side of a selected roadway where the security barricade would be desired. Depending on the size and lift capability of a crane that would be used to positioned the container 55 with the support structure 15 housed therein, the container 55 could also house the roller barrier 12, or the roller barrier 12 could be installed on the support apparatus 15 after the container 55 is appropriately positioned.

The container is formed with a side door 57 that would face the roadway to be barricaded. The side door 57 is preferably hinged at the bottom edge and latched by a conventional latch mechanism (not shown) at the top edge to that the actuation of the solenoids 39, 49 to activate the primary and secondary release mechanisms 30, 40 would also unlatch the side door 57 whereupon the off-centered hinge 58 will cause the side door 57 to fall to an opened position and form the ramp 18 over which the roller barrier can move to reach the roadway surface. Therefore, when the roller barrier 12 rolls off of the elevated support surface 17, the weight of the roller barrier 12 will assure that the side door 57 moves into the opened position and forms the ramp 18, over which the roller barrier can move to reach the roadway.

Preferably, the container 55 will have access doors or openings (not shown) that will enable the support structure 15 and the release mechanisms 30, 40 to be accessed for maintenance and testing. The container 55 may have an open top portion to facilitate the loading of the roller barrier(s) 12 into the support apparatus 15 when the container 55 is properly located along the side of a selected roadway, and for re-loading a roller barrier 12 into the support apparatus 15 in the event the roller barrier security system 10 has been activated to barricade the selected roadway surface.

To install the vehicle security barrier 10, the support apparatus 15 is positioned on opposite sides of the roadway surface, with or without support within the container 55, and electricity run to each of the solenoids 39, 49. All of the first solenoids 39 are coupled together electrically or mechanically so that a single control (not shown) accessible by the operator will actuate all of the first solenoids simultaneously. Similarly, all of the second solenoids 49 are electrically coupled so that a second control (not shown) can actuate all of the second solenoids simultaneously. The roller members 12 are formed by pouring concrete into the conduit shell 13 and allowing the concrete to harden. The roller members 12 can then be positioned on the cradles 17 on the vertical fins 20 at corresponding positions on opposite sides of the roadway surface, by using an appropriate crane (not shown) or utilizing a winch (not shown) to roll the roller members 12 up the ramp 18 into the cradle 17.

Figure 3:
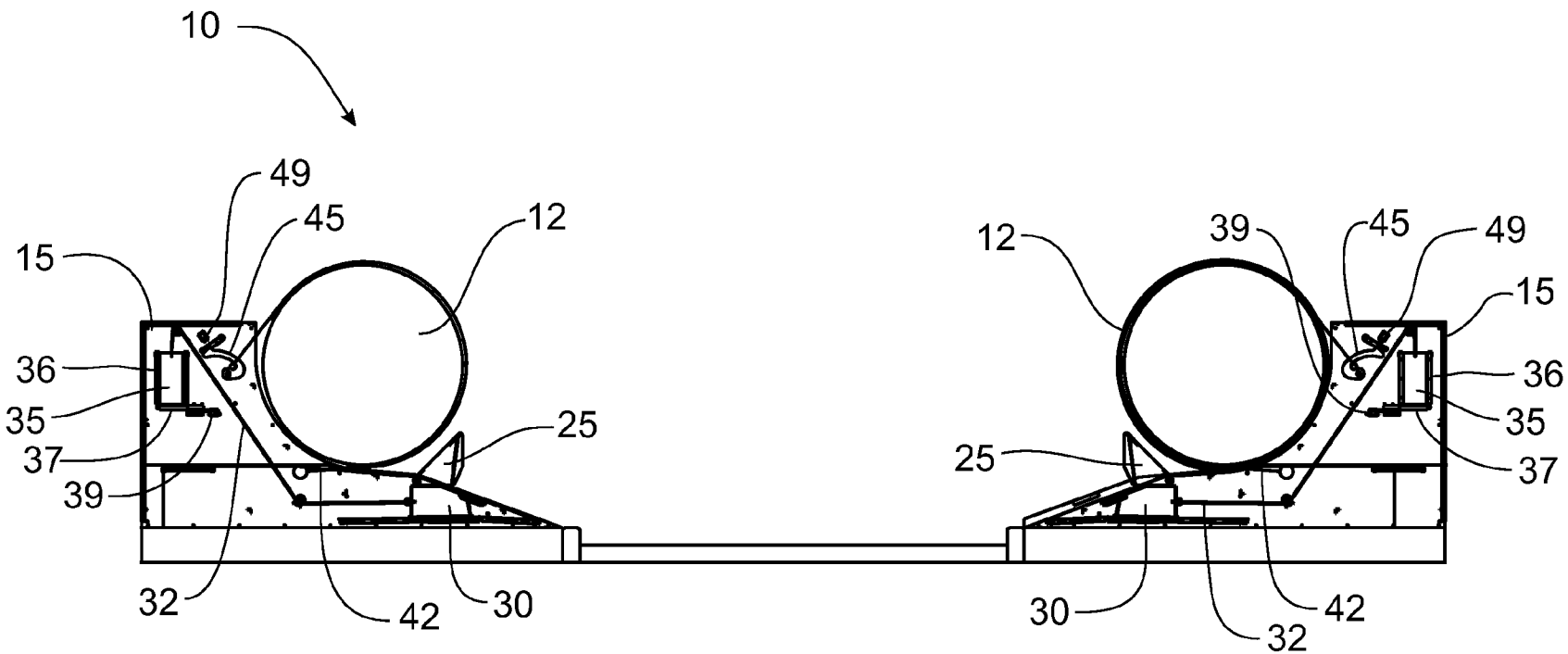
FIG. 3 is a front elevational view of the vehicle security barrier shown in FIGS. 1 and 2.

The restraint cables 42 can then be wrapped around the roller member 12 and secured on the bayonet hook member 45, which is held in the locked position by the second solenoid 49. With the wrapping of the restraint cable 42 around the roller member 12, the roller member 12 is secured in the elevated, ready position. The catch member 25 can be raised from the slot 19 by moving the slide block 30 forwardly to push the catch member 25 upwardly, and the drop weight 35 secured in the channel 36 by closing the trap door 37 and securing the trap door with the first solenoid 39. Thus, the vehicle security barrier 10 is positioned in the ready position, which is depicted in FIGS. 3 and 4.

Figure 5:
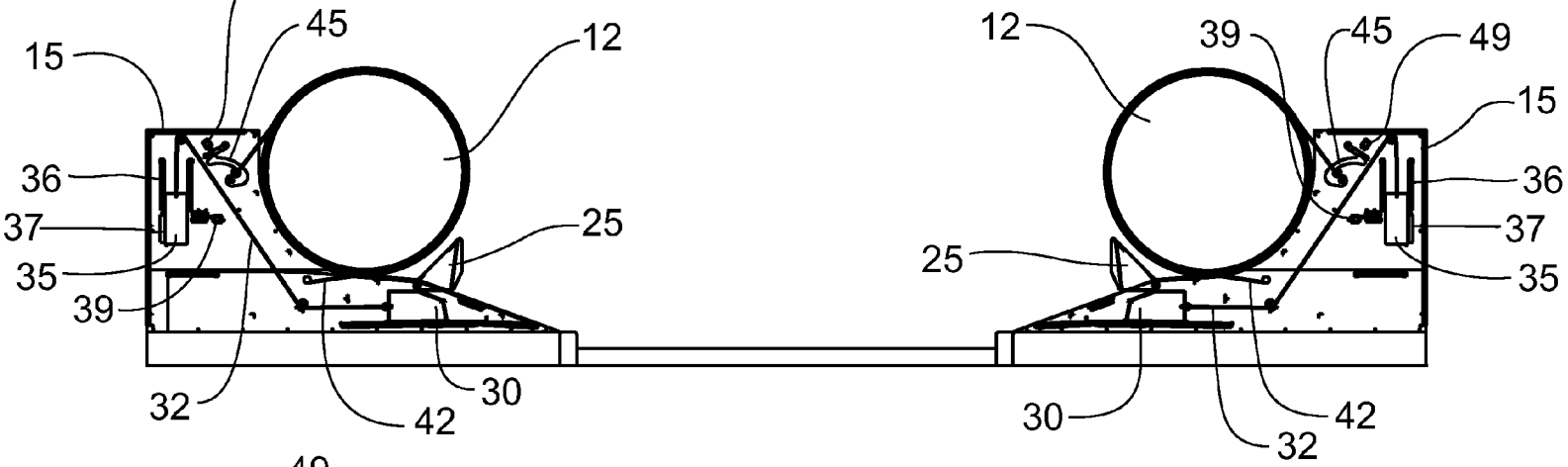
FIG. 5 is a front elevational view of the vehicle security barrier similar to that of FIG. 3 to show the operation of the vehicle security barrier, the deployment of the barrier being initiated.
Figure 7:
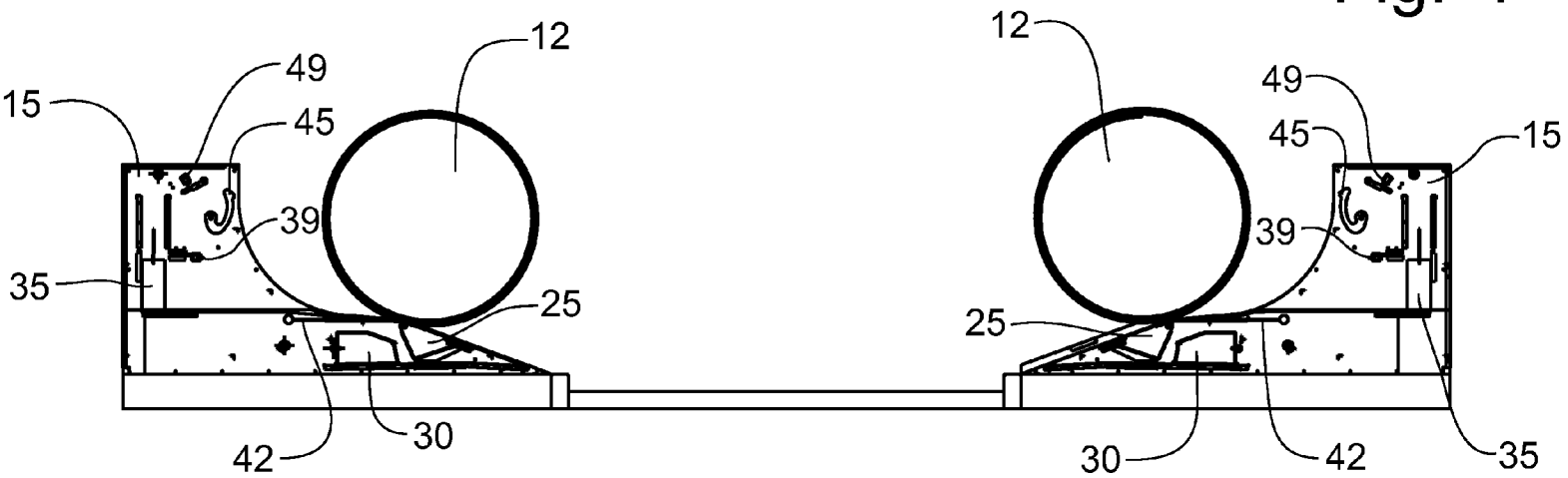
FIG. 7 is a front elevational view of the vehicle security barrier depicted in FIG. 6, but showing the release of the second actuator to allow movement of the roller member.
Figure 8:
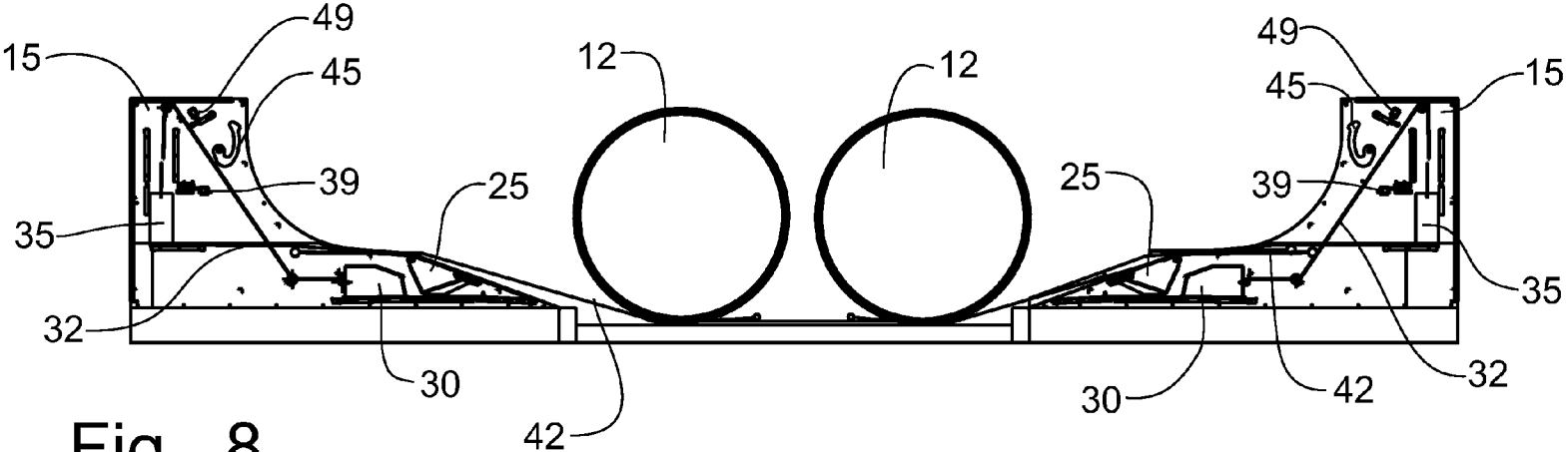
FIG. 8 is a front elevation view of the vehicle security barrier similar to that of FIG. 7, but showing the roller members moved into a barricading position.

When the security barrier 10 needs to be activated to stop the passage of vehicles, the operator must first actuate the first solenoid 39, as is demonstrated in FIG. 5, to allow the trap door 37 to swing away from the channel 36 and the drop weight 35 to move vertically by gravity. As noted above, the vertical displacement of the drop weight 35 pulls on the cable 32 to retract the slide block 30, which in turn allows the catch member 25 to retract into the slot 19 into the location previously occupied by the slide block 30, as is depicted in FIG. 6. The actuation of the first solenoid 39 enables the release of the roller member 12 by actuation of the second solenoid 49 to release the bayonet hook member 45 and the roller member 12 restrained by the restraint cable 42, as is depicted in FIG. 7. Subsequently, the roller member 12 will roll down the ramp 18 onto the road surface. Since both opposing roller members 12 are released simultaneously, the roller members 12 will impact one another at the center of the roadway surface and block passage of vehicles, as is depicted in FIG. 8.

One skilled in the art will note that if the operator were to release the second solenoid 49 before the first solenoid 39, the roller member 12 would not be restrained in the elevated ready position by the restraint cable 42 and, thus, would start to roll down the ramp portion 23 into engagement with the catch members 25. With the weight of the roller members 12 on the catch members 25, which in turn is transmitted to the slide blocks 30 beneath the catch members 25, the drop weight 35 would not exert sufficient force to retract the slide blocks 30, resulting in the roller members 12 being restrained by the catch members 25. One skilled in the art will also note that the use of two actuators 39, 49 to release the roller members 12 to move onto the roadway surface serves as a safety mechanism in the event one of the solenoids 39, 49 would be accidentally actuated or would fail.

Figure 9:
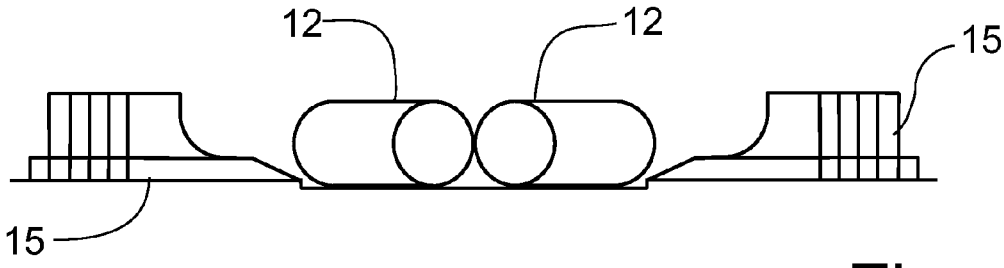
FIG. 9 is a front elevational view similar to that of FIG. 3, but showing an alternative configuration in which the roller members are oriented to move in a path that is oriented angularly to the roadway surface to provide a wider coverage of the deployed roller members.
Figure 10:
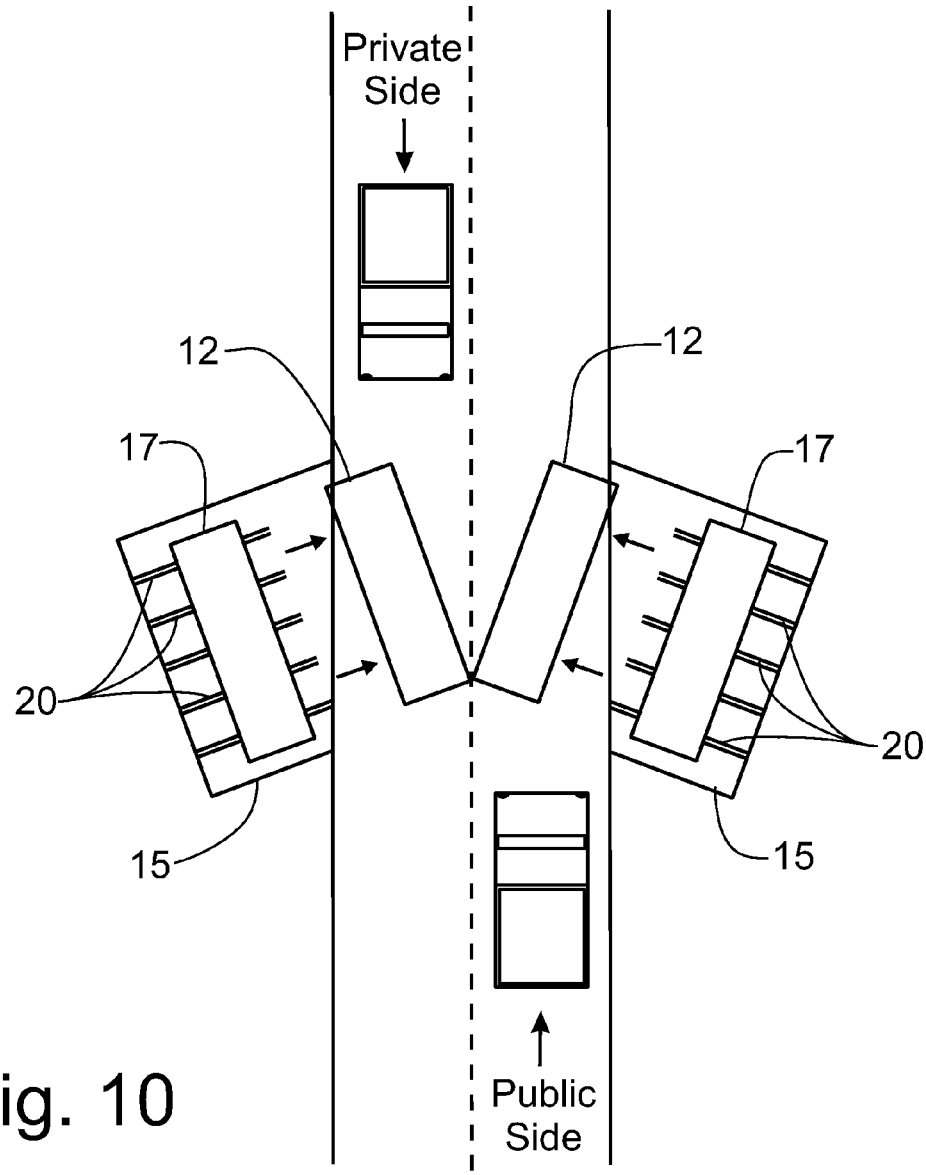
FIG. 10 is a top plan view of the alternative vehicle security barrier as depicted in FIG. 9.

A second embodiment of the vehicle security barrier 10 is shown in FIGS. 9 and 10 to cover a roadway surface that is greater than one lane in width. By orienting the support apparatus 15 at an angle to the direction of travel on the roadway surface, and by utilizing roller members 12 that have a sufficient length, the release of the roller members 12, as described above, will result in the roller members 12 moving obliquely to the direction of travel over the roadway surface down the ramps 18. The impact between the two opposing roller members 12 will result in the roller members 12 being angled across the roadway surface, as is reflected in FIG. 10, thus covering a transverse distance that is larger than the combined diameters of the roller members 12. As noted on FIG. 10, the support apparatus 15 should be angled so that the end result of the impacted roller members 12 has the ends thereof facing the incoming traffic from the public side of the security barrier 10.

One skilled in the art will recognize that once the roller barrier security system 10 has been activated and the roller barriers 12 deployed onto the adjacent roadway surface to barricade the selected portion of the roadway, the roller barriers 12 can be re-loaded onto the support apparatus 15 where the release mechanism 40 can be re-attached and the catch members 25 re-engaged with the slide blocks 30 to return the roller barrier security system 10 to a restrained state ready for deployment. Although adequately sized equipment, such as a crane, would be necessary to remove the roller barriers 12 from the roadway surface and re-load the roller barriers 12 onto the respective support apparatus 15, the deployment of the roller barrier system 10 does not preclude a re-utilization of the system 10 for subsequent deployments.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

For example, one skilled in the art will recognize that different actuators and associated linkage and components for releasing the catch members 25 and the restraint cables 32 can be provided within the scope of the invention. The components associated with the first and second solenoids 39, 49 described above were selected to provide minimal forces on the solenoids 39, 49 without requiring excessive stroke for either of the solenoids 39, 49. In the alternative, mechanical linkages (not shown) could be coupled with the respective solenoids 39, 49 to cause the release of the catch members 25 and/or the restraint cables 42, respectively. Other forms of actuators could also be utilized, including pneumatic or hydraulic cylinders, magnetic latches, mechanical linkages, etc., each of which could be combined with others. Furthermore, reliance on gravity to cause the sliding movement of the slide block via the drop weight, or the release of the restraint cables 42 can be replaced by powered mechanisms.

As another example, the roller members 12 can be oriented in multiples on each side of the highway, with all roller members 12 being positioned on a ramp support surface 18 that will allow gravity to roll the roller barriers 12 onto the highway to form a barricade thereon. The utilization of multiple roller members 12 on each side of the highway would allow the use of smaller diameter roller members 12, and/or allow the deployed roller members 12 to barricade a wider highway span.

As a further example, one or more of the ends of the roller barriers 12 can be formed with a soft pillow-like barrier 14, as reflected in FIG. 1, to provide a less rigid impact surface at the end or ends of the roller barriers 12 in the event that a vehicle actually runs into the barriers 12 once deployed onto the roadway.

Having thus described the invention, what is claimed is:

1. A security barrier for selectively preventing the passage of vehicles along a roadway comprising:

a pair of support members respectively positioned on opposing transverse sides of the roadway, each said support member being formed with an elevated support surface and an inclined ramp leading downwardly from the elevated support surface toward the roadway;

a pair of cylindrical roller barriers supported respectively on said elevated support surfaces, said roller barriers being sized such that a positioning of said roller barriers on said roadway would prevent passage of vehicles along the roadway; and a releasable restraint mechanism mounted on each said support member and engagable with each said roller barrier to retain said roller barriers on the respective elevated support surface.

2. The security barrier of claim 1 wherein each said restraint mechanism includes a first restraint apparatus and a second restraint apparatus.

3. The security barrier of claim 2 wherein each said first restraint apparatus comprises:

at least one cable anchored at a fixed end on said support member and having a length sufficient to wrap around said roller barrier and terminate in a distal end; and a first releasable actuator mechanism coupled to said distal end to selectively fix said distal end on said support member, said cable wrapped around the corresponding roller barrier and being secured to said support member at both said fixed and distal ends being operable to retain said roller barrier on said elevated support surface.

4. The security barrier claim 3 wherein each said first releasable actuator mechanism comprises:

a pivoted hook member engagable with said distal end of said cable, said hook member being movable between a latch position in which said distal end of said cable is secured to said support member and a release position in which said distal end of said cable is free to move relative to said support member, whereby the corresponding said roller barrier is released to roll down said inclined ramp; and a first actuator engagable with said hook member to selectively allow said hook member to move from said latch position to said release position.

5. The security barrier of claim 4 wherein each said first actuator comprises:

a pivoted trap link movable between a securing position engagable with said hook member when in said latch position to retain said hook member in said latch position; and a first solenoid operably coupled to said trap link to selectively move said trap link into an opened position that allows said hook member to move from said latch position to said release position.

6. The security barrier of claim 3 wherein each said second restraint mechanism comprises:

at least one catch member pivotally mounted to the corresponding said support member below said elevated support surface, said catch member being movable between an upright interfering position that prevents said roller barrier from moving from said elevated support surface down said inclined ramp and a lowered non-interfering position in which said roller barrier can move down said inclined ramp;

a second releasable actuator mechanism operably associated with said pivoted catch member to control the movement thereof from said interfering position to said non-interfering position.

7. The security barrier of claim 6 wherein said at least one catch member is retractable into a slot formed in said inclined ramp when moved from said interfering position into said non-interfering position.

8. The security barrier of claim 6 wherein each said second releasable actuator mechanism comprises:

a slide block located beneath said inclined ramp and having a first position engagable with said at least one catch member to prevent said at least one catch member from moving to said non-interfering position, said slide block being movable into a second position to allow said at least one catch member to move into said non-interfering position; and an actuation device coupled to said slide block to move said slide block from said first position to said second position.

9. The security barrier of claim 8 wherein said actuation device comprises:

a drop weight connected to said slide block and being movable from a raised position to a lowered position;

a trap door retaining said drop weight into said raised position; and a second actuator coupled to said trap door and being operable to open said trap door to allow said drop weight to move to a lowered position which moves said slide block to said second position.

10. The security barrier of claim 9 wherein said second actuator is a second solenoid which is independently operable from said first releasable actuator mechanism.

11. The security barrier of claim 1 wherein said roller barriers are housed within a container having a side door movable from a closed position to an opened position in which said side door forms said inclined ramp.

12. The security barrier of claim 1 wherein said roller barriers when positioned on said support surface on said support members have a longitudinal axis oriented at an oblique angle to said roadway.

13. The security barrier of claim 1 wherein in said roller barriers are formed from concrete.

14. A method of selectively preventing the passage of vehicles along a roadway comprising the steps of:

supporting a first cylindrical roller barrier on an elevated support surface of a first support member along one transverse side of said roadway, said first support member having an inclined ramp leading downwardly from said elevated support surface toward said roadway;

supporting a second cylindrical roller barrier on an elevated support surface of a second support member along an opposing transverse side of said roadway, said second support member having an inclined ramp leading downwardly from said elevated support surface toward said roadway; and simultaneously releasing both said roller barriers to roll down the respective said inclined ramps by gravity onto said roadway so that said roller barriers will impact one another and come to rest on said roadway to prevent the passage of vehicles.

15. The method of claim 14 wherein said releasing step includes the steps of:

activating a first releasable actuator mechanism associated with each said roller barrier to release a first restraint apparatus restraining said roller barrier on said elevated support surface; and independently activating a second releasable actuator mechanism associated with each said roller barrier to release a second restraint apparatus restraining said roller barrier on said elevated support surface.

16. The method of claim 15 wherein said step of activating a first releasable actuator mechanism comprises the steps of:

manipulating a first actuator to release a distal end of a cable anchored at a fixed end to the corresponding said support member and wrapped around the corresponding said roller barrier so that said cable is released to allow said roller barrier to move down the corresponding said inclined ramp.

17. The method of claim 16 wherein said step of activating a second releasable actuator mechanism comprises the steps of:

manipulating a second actuator to release a trap door restraining a drop weight in a raised position;

lowering said drop weight from said raised position to a lowered position, said drop weight being coupled to a slide block interfering with movement of a pivoted catch member positioned below the corresponding said roller barrier; and sliding said slide block in response to said lowering step into a non-interfering position to allow said catch member to pivot away from said roller barrier, thus allowing said roller barrier to move down the corresponding said inclined ramp.

18. A security barrier for deployment on a roadway surface to prevent in a selective manner the passage of vehicles over said roadway surface, comprising:

a pair of support members respectively positioned on opposing transverse sides of the roadway, each said support member being formed with an elevated support surface and an inclined ramp leading downwardly from the elevated support surface toward the roadway;

a pair of cylindrical roller barriers supported respectively on said elevated support surfaces, said roller barriers being sized such that a positioning of said roller barriers on said roadway would prevent passage of vehicles along the roadway; and a first restraint apparatus including at least one cable anchored at a fixed end on said support member and having a length sufficient to wrap around said roller barrier and terminate in a distal end, and a first releasable actuator mechanism coupled to said distal end to selectively fix said distal end on said support member, said cable being wrapped around the corresponding roller barrier and being secured to said support member at both said fixed and distal ends being operable to retain said roller barrier on said elevated support surface; and a second restraint apparatus including at least one catch member pivotally mounted to the corresponding said support member below said elevated support surface, said catch member being movable between an upright interfering position that prevents said roller barrier from moving from said elevated support surface down said inclined ramp and a lowered non-interfering position in which said roller barrier can move down said inclined ramp, and a second releasable actuator mechanism operably associated with said pivoted catch member to control the movement thereof from said interfering position to said non-interfering position, said second restraint apparatus being operable independently of said first restraint apparatus.

19. The security barrier claim 18 wherein each said first releasable actuator mechanism comprises:

a pivoted hook member engagable with said distal end of said cable, said hook member being movable between a latch position in which said distal end of said cable is secured to said support member and a release position in which said distal end of said cable is free to move relative to said support member, whereby the corresponding said roller barrier is released to roll down said inclined ramp;

a pivoted trap link movable between a securing position engagable with said hook member when in said latch position to retain said hook member in said latch position; and a first solenoid operably coupled to said trap link to selectively move said trap link into an opened position that allows said hook member to move from said latch position to said release position.

20. The security barrier of claim 18 wherein said roller barriers are housed within a container having a side door movable from a closed position to an opened position in which said side door forms said inclined ramp.

* * * * *